US008573010B2

(12) United States Patent
Burmesch et al.

(10) Patent No.: US 8,573,010 B2
(45) Date of Patent: Nov. 5, 2013

(54) LATCHING ARRANGEMENTS FOR A PADLOCK

(75) Inventors: Gary Burmesch, Port Washington, WI (US); Dean A. Paulson, Oak Creek, WI (US); Thomas J. Schlaefer, Delafield, WI (US); John Weber, Thiensville, WI (US)

(73) Assignee: Master Lock Company LLC, Oak Creek, WI (US)

( * ) Notice: Subject to any disclaimer, the term of this patent is extended or adjusted under 35 U.S.C. 154(b) by 127 days.

(21) Appl. No.: 13/233,363

(22) Filed: Sep. 15, 2011
(Under 37 CFR 1.47)

(65) Prior Publication Data

US 2012/0085136 A1 Apr. 12, 2012

Related U.S. Application Data

(60) Provisional application No. 61/382,974, filed on Sep. 15, 2010.

(51) Int. Cl.
*E05B 37/06* (2006.01)

(52) U.S. Cl.
USPC ..... 70/25; 70/38 B; 70/314; 70/21

(58) Field of Classification Search
USPC ..... 70/21, 22, 25, 38 B, 314
See application file for complete search history.

(56) References Cited

U.S. PATENT DOCUMENTS

| | | | | | |
|---|---|---|---|---|---|
| 703,387 | A | * | 7/1902 | Craig | 70/322 |
| 1,270,205 | A | * | 6/1918 | Pongracz | 70/38 B |
| 1,310,930 | A | * | 7/1919 | Richardson | 70/27 |
| 1,317,221 | A | * | 9/1919 | Roshon | 70/314 |
| 1,320,139 | A | * | 10/1919 | Hanflig | 70/322 |
| 1,369,850 | A | * | 3/1921 | Steen | 70/25 |
| 1,888,647 | A | * | 11/1932 | Winning | 70/25 |
| 2,113,864 | A | * | 4/1938 | Soref et al. | 70/25 |
| 2,115,042 | A | * | 4/1938 | Olson | 70/21 |
| 2,127,091 | A | * | 8/1938 | Soref et al. | 70/25 |
| 2,135,317 | A | * | 11/1938 | Winning | 70/25 |
| 2,148,226 | A | | 2/1939 | Aldeen | |
| 2,245,741 | A | | 6/1941 | Winning | |
| 2,658,779 | A | | 11/1953 | Dall | |

(Continued)

OTHER PUBLICATIONS

International Search Report and Written Opinion from International Application No. PCT/US11/51705, mailed Feb. 13, 2012.

(Continued)

*Primary Examiner* — Suzanne Barrett

(74) *Attorney, Agent, or Firm* — Calfee, Halter & Griswold LLP

(57) ABSTRACT

A latch assembly for a padlock includes a rocker having a central through bore and a tongue extending from an outer periphery of the rocker. A latch member is slidably disposed in a cavity in the rocker. A torsion spring is assembled to a spring retaining surface of the rocker and includes first and second legs extending from a center coil portion positioned around the through bore. The first leg extends beyond the outer periphery of the rocker, and the second leg terminates inward of the outer periphery of the rocker and engages a portion of the rocker to apply a biasing force against the rocker when the first leg is in a spring-loaded condition. The rocker comprises at least one spring fastening member securing the torsion spring to the spring retaining surface of the rocker.

18 Claims, 4 Drawing Sheets

(56) References Cited

U.S. PATENT DOCUMENTS

| | | | | | |
|---|---|---|---|---|---|
| 2,893,231 | A | | 7/1959 | Soref et al. | |
| 2,926,514 | A | * | 3/1960 | Junkunc | 70/21 |
| 3,270,534 | A | | 9/1966 | Junkunc | |
| 3,406,545 | A | | 10/1968 | Siegel | |
| 3,563,067 | A | | 2/1971 | Foote | |
| 3,990,275 | A | | 11/1976 | Lippisch | |
| 4,034,169 | A | * | 7/1977 | Armstrong et al. | 200/50.12 |
| 4,055,972 | A | | 11/1977 | Calegan | |
| 4,170,884 | A | * | 10/1979 | Calegan | 70/21 |
| 4,422,311 | A | | 12/1983 | Zabel et al. | |
| 4,462,231 | A | * | 7/1984 | Zabel | 70/21 |
| 5,046,340 | A | | 9/1991 | Weinerman et al. | |
| 7,611,431 | B2 | | 11/2009 | Dinca et al. | |
| 8,099,985 | B2 | * | 1/2012 | Burmesch et al. | 70/25 |

OTHER PUBLICATIONS

Preliminary Report on Patentability from International Application No. PCT/US2011/051705, dated Mar. 19, 2013.

* cited by examiner

LATCHING ARRANGEMENTS FOR A PADLOCK

CROSS-REFERENCE TO RELATED APPLICATION

This application claims the benefit of U.S. Provisional Patent Application Ser. No. 61/382,974, entitled "LATCHING ARRANGEMENTS FOR A PADLOCK" and filed Sep. 15, 2010, the entire contents of which are incorporated herein by reference, to the extent that they are not conflicting with the present application.

BACKGROUND

Padlocks are used in a variety of applications, including, for example, with enclosures such as lockers, storage sheds, and various gates and doors, to secure two or more hasps, latches or other structures together to restrict access to an item or enclosure. A conventional padlock includes a shackle having two ends secured within a lock body by one or more locking members when in a locked condition, with the locking members being disengageable from the shackle in the unlocked condition to allow movement of the shackle to separate one end (or leg) of the shackle from the lock body. Some padlocks include key operated arrangements in which insertion of a proper key in a keyway permits rotation of a key cylinder to release or disengage one or more locking members from the shackle. Other padlocks include a combination (or permutation) dial operable to rotate a plurality of tumbler discs to an unlocking orientation, in which the tumbler discs permit disengagement of one or more locking members from the shackle.

While many different locking arrangements may be employed in a padlock, in one embodiment, a padlock may include a pivoting rocker with a sliding latch that is secured in engagement with a corresponding notch in a short leg of a U-shaped shackle when the padlock is locked. When the padlock is unlocked, the rocker and latch are pivotable out of engagement with the shackle notch to permit withdrawal of the short leg of the shackle from the lock body. Examples of such padlocks are described in U.S. Pat. Nos. 3,563,067 and 4,055,972, the entire disclosures of which are incorporated herein by reference, to the extent that they are not conflicting with the present application.

SUMMARY

The present application describes padlocks utilizing a pivoting rocker-style latch assembly for locking engagement with the padlock's shackle. According to an exemplary aspect of the present application, a latch assembly may be configured to be provided as a self-contained subassembly, for example, for ease of manufacture.

Accordingly, in an exemplary embodiment, a padlock includes a lock body, a shackle, a locking mechanism, and a latch assembly. The shackle includes long and short legs receivable in corresponding first and second shackle openings extending from an upper surface of the lock body and axially moveable between a retracted position and an extended position. The short leg is withdrawn from the lock body when in the extended position. The locking mechanism is disposed in the lock body and includes a plurality of tumbler discs and a user operable dial configured to selectively rotate each of the plurality of tumbler discs to an unlocking orientation. The latch assembly is disposed in the lock body and includes a rocker pivotably mounted to a post secured to the lock body, and a latch member extending from the pivotable rocker. When the plurality of tumbler discs are pivoted to the unlocking orientation, the pivotable rocker is permitted to pivot from a first position to a second position to move the latch member out of locking engagement with a recess in the short shackle leg. The latch assembly further includes a torsion spring having first and second legs and a center coil portion between the first and second legs and assembled over the post. The first leg engages an inner surface of the lock body, and the second leg engages the rocker to bias the rocker toward the first position. The rocker further includes at least one spring fastening member securing the torsion spring to a spring retaining surface of the rocker against movement away from the rocker along the post.

In another exemplary embodiment of the present application, a latch assembly for a padlock includes a rocker having a central through bore and a tongue extending from an outer periphery of the rocker. A latch member is slidably disposed in a cavity in the rocker, and is spring biased toward an extended position. A torsion spring is assembled to a spring retaining surface of the rocker and includes first and second legs extending from a center coil portion positioned around the through bore. The first leg extends beyond the outer periphery of the rocker, and the second leg terminates inward of the outer periphery of the rocker and engages a portion of the rocker to apply a biasing force against the rocker when the first leg is in a spring-loaded condition. The rocker comprises at least one spring fastening member securing the torsion spring to the spring retaining surface of the rocker.

According to another exemplary aspect of the present application, a method of manufacturing a padlock latch assembly as a self-contained subassembly is contemplated. In one exemplary method, a latch member is assembled into a cavity of a rocker to extend from an outer periphery of the rocker, such that the latch member is slideable between an extended position and a retracted position. A torsion spring is placed on a spring retaining surface of the rocker such that a central coil portion of the torsion spring is positioned around a through bore in the rocker, a first leg extending from the central coil portion extends outward of the outer periphery of the rocker, and a second leg extending from the central coil portion opposite the first leg is positioned adjacent a projection extending from the spring retaining surface of the rocker. The projection is deformed to secure the torsion spring to the spring retaining surface of the rocker.

BRIEF DESCRIPTION OF THE DRAWINGS

Features and advantages of the invention will become apparent from the following detailed description made with reference to the drawings, wherein.

DETAILED DESCRIPTION

Figure 1:
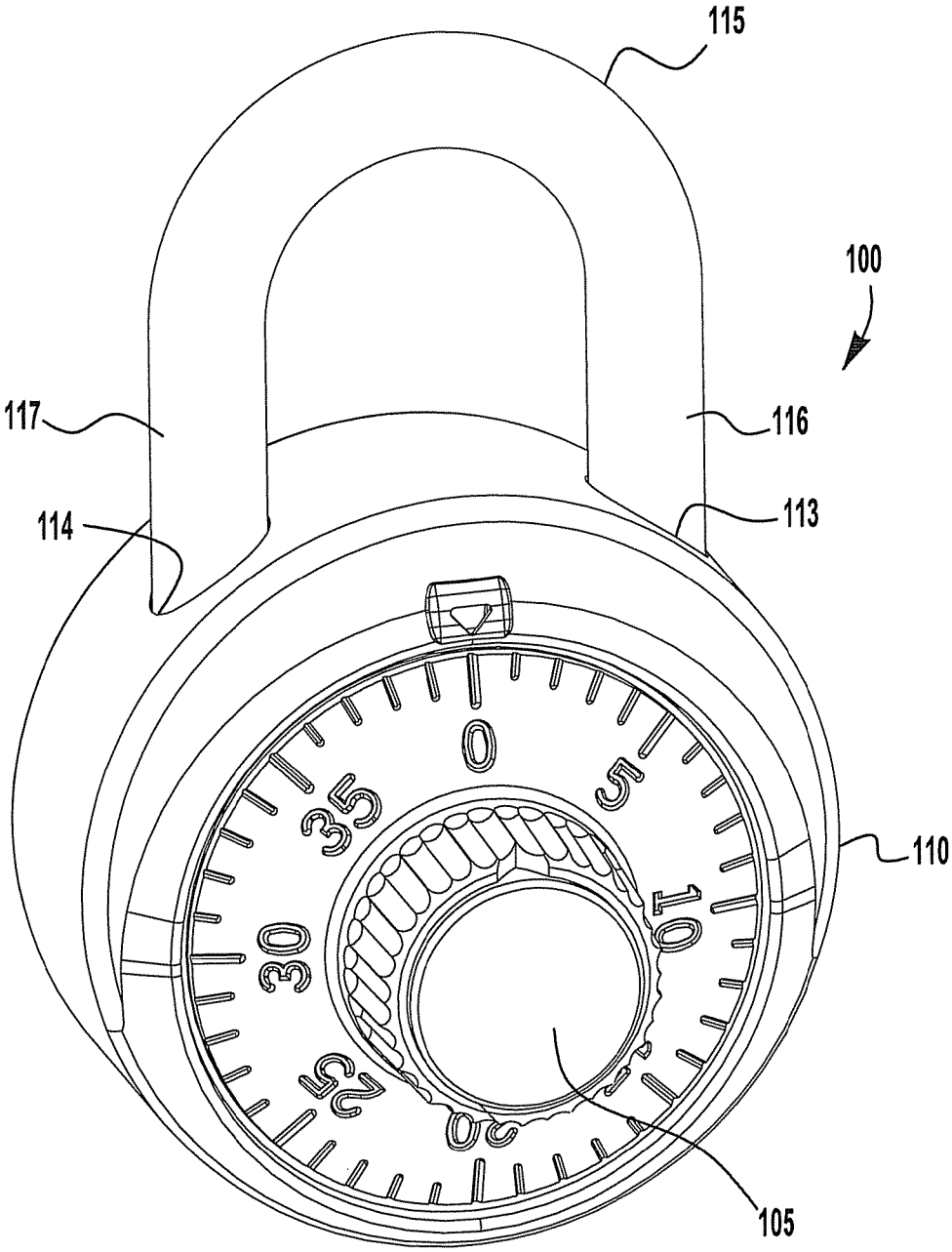
FIG. 1 is a perspective view of an exemplary combination padlock.
Figure 2C:
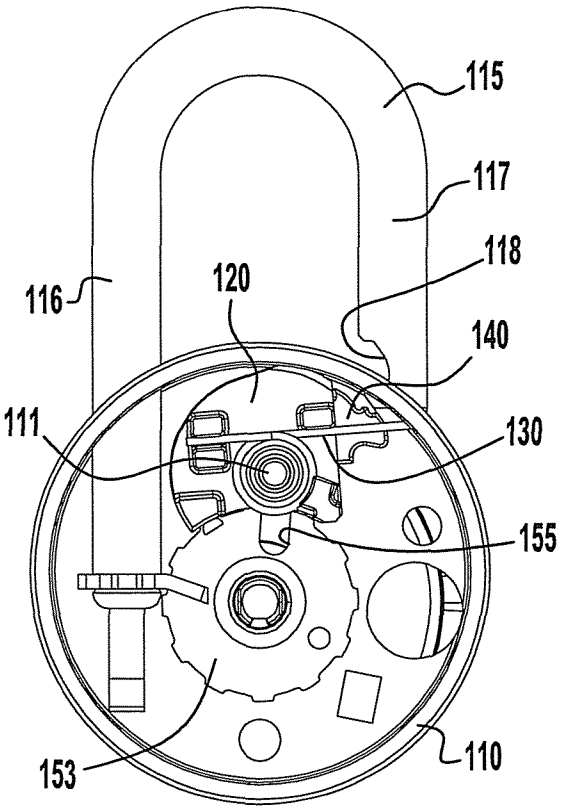
FIG. 2C is a rear cross-sectional view of the combination padlock of FIG. 1 in an unlocked or shackle released condition.
Figure 2B:
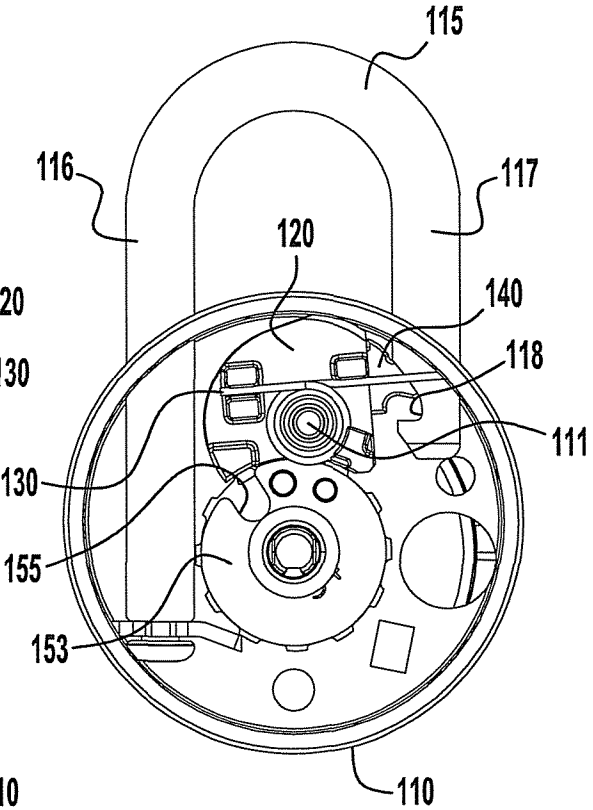
FIG. 2B is a rear cross-sectional view of the combination padlock of FIG. 1 in the locked condition.
Figure 2A:
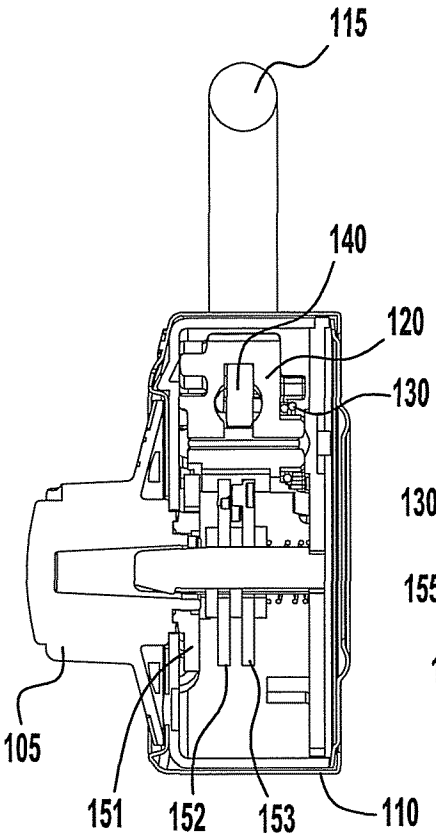
FIG. 2A is a side cross-sectional view of the combination padlock of FIG. 1, shown in a locked condition.

This Detailed Description merely describes embodiments of the invention and is not intended to limit the scope of the claims in any way. Indeed, the invention as claimed is broader than and unlimited by the preferred embodiments, and the terms used in the claims have their full ordinary meaning.

The present application contemplates various inventive features associated with a spring and rocker arrangement for a combination padlock. According to an aspect of the present application, a rocker and torsion spring assembly may be adapted for simplicity of manufacture, ease of assembly, minimization of wear, and consistency of operation.

FIGS. 1-5 illustrate various features of an exemplary rocker-style combination padlock 100 having a lock body 110, a shackle 115 having long and short legs 116, 117 receivable in corresponding first and second shackle openings 113, 114 in an upper surface of the lock body 110, and a user operable combination dial 105 configured to unlock a locking mechanism when rotated to a sequence of predetermined positions. As shown in FIGS. 2A-5, the combination padlock 100 includes a pivotable lever or rocker 120 that receives a spring-loaded slidable latch member 140 in a cavity 122 (see FIGS. 4 and 5) of the rocker 120 for locking engagement with a corresponding notch 118 in the shackle short leg 117. The latch member 140 may be secured within the rocker 120 by a pin 148 or other such fastener installed in the rocker 120 in alignment with a corresponding recess 143 (see FIG. 5) in the latch member 140. This arrangement allows the rocker 120 and latch member 140 to be retained as a self-contained or pre-assembled latch assembly, for example, for ease of assembly, storage, and installation.

Figure 3:
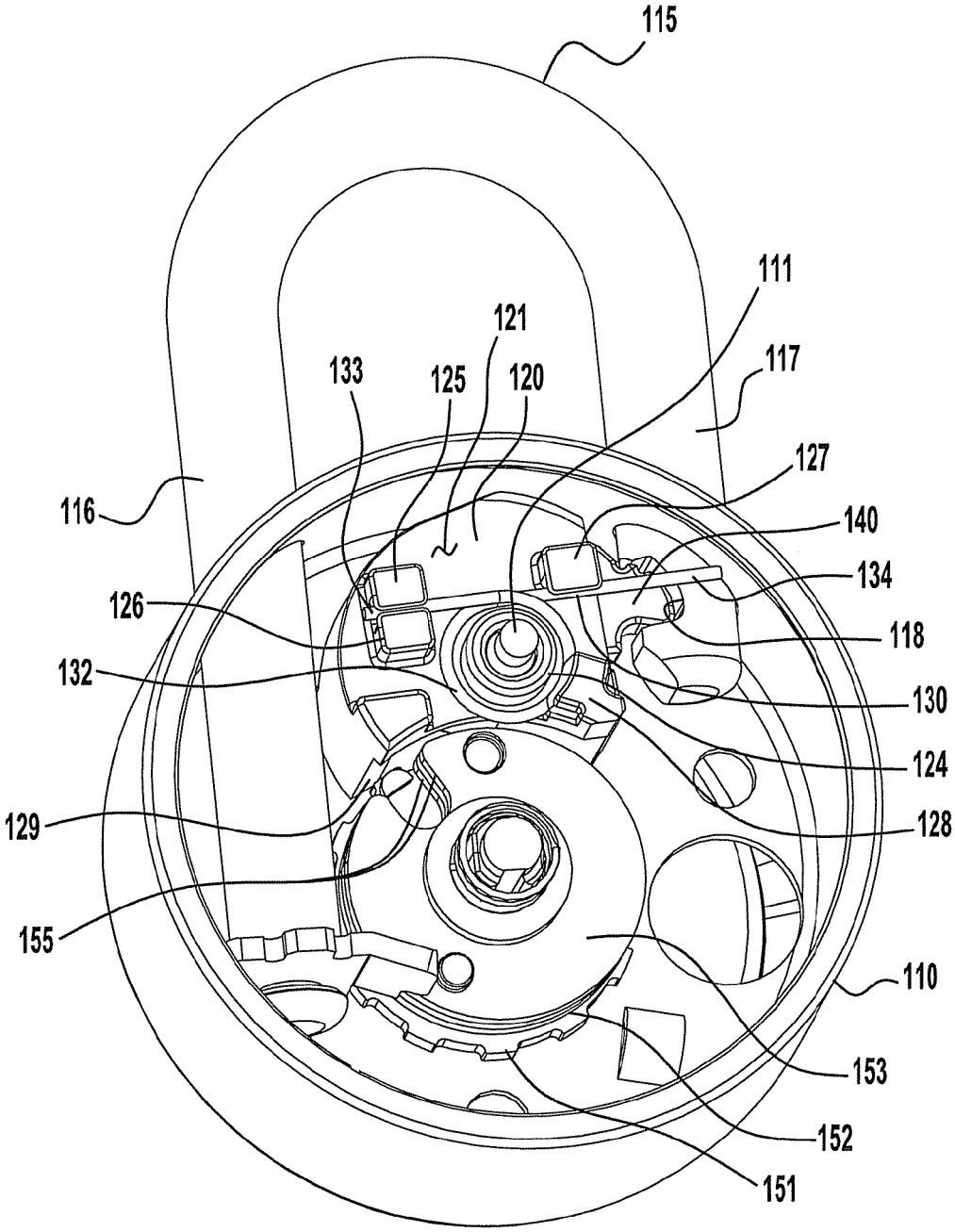
FIG. 3 is a partial rear perspective view of the combination padlock of FIG. 1, with portions of the lock removed to illustrate additional features of the lock.

The rocker 120 is pivotally biased (about post 111) into a locking orientation by a torsion spring 130 assembled with the rocker 120 and bearing against an inner surface of the lock body 110. In this locking orientation, as shown in FIG. 3, the latch member 140 is prevented from retracting out of engagement with the shackle notch 118. When the combination dial 105 is rotated to the proper sequence of positions (see FIG. 2B), slots 155 in a plurality of tumbler discs 151, 152, 153 align with an extension or tongue 129 of the rocker 120, thereby permitting the rocker 120 to be pivoted against the torsion spring 130 and into engagement with the aligned slots 155 to an unlocking orientation when the shackle 115 is pulled. In this second orientation, the latch member 140 becomes disengaged from the shackle notch 118, such that the short leg 117 of the shackle 115 may be withdrawn from the lock body 110 to unlock the padlock 100 (see FIG. 2C). Once the latch member 140 is disengaged from the shackle 115, the torsion spring 130 returns the rocker 120 to the locking orientation. To re-lock the padlock, reinsertion of the short leg 117 of the shackle 115 into the shackle opening 114 causes the end of the short shackle leg 117 to cam against the latch member 140, retracting the latch into the rocker 120 to permit full insertion of the shackle 115. When the shackle notch 118 is realigned with the latch member 140, a spring 141 disposed within the cavity 122 forces the latch member 140 back into locking engagement with the shackle notch 118.

Figure 4:
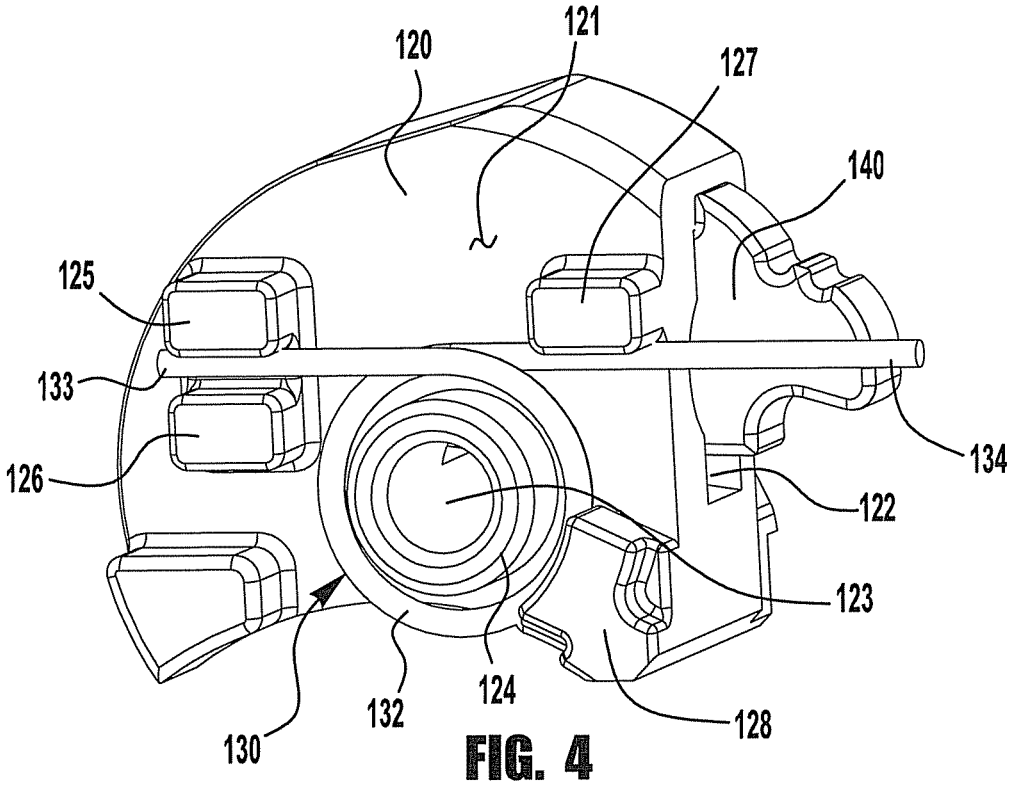
FIG. 4 is a perspective view of the latch assembly of the combination padlock of FIG. 1.
Figure 5:
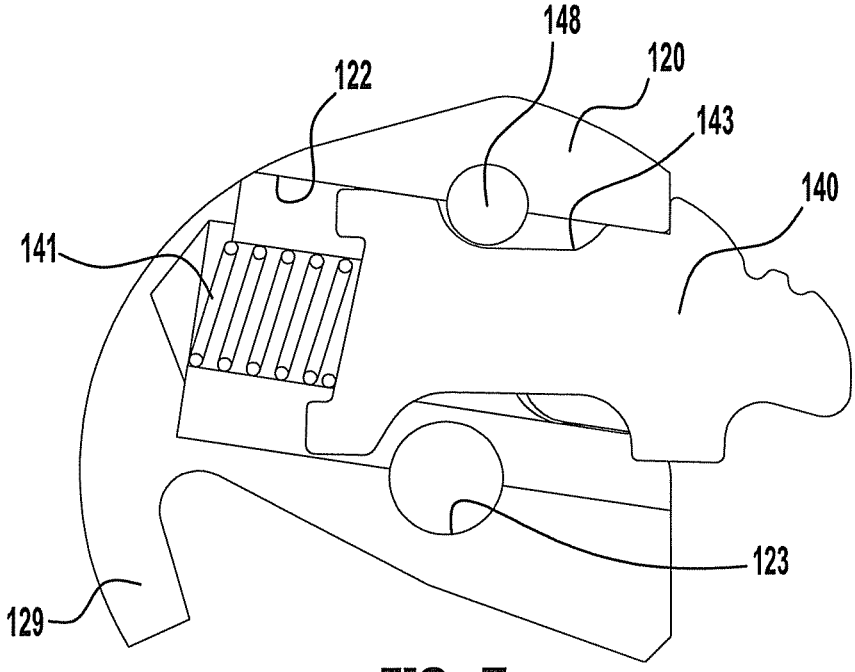
FIG. 5 is a cross sectional view of the latch assembly of FIG. 4.

The exemplary rocker 120 and torsion spring 130 assembly are more closely shown in FIGS. 3 and 4. When the rocker 120 is pivoted about the pivot pin or post 111 to an unlocking orientation, the torsion spring 130 flexes between the rocker 120 (for example, against a projection 126) and an inner surface of the lock body 110. A first leg 134 of the torsion spring extends beyond an outer periphery of the rocker 120 to engage the inner surface of the lock body. A second leg 133 of the torsion spring is anchored against or in driving engagement with a portion of the rocker and may (but need not) terminate inward of the outer periphery of the rocker. This arrangement provides for a spring biased return of the rocker 120 to a locking orientation upon disengagement of the shackle 115 from the sliding latch member 140. A center coil portion 132 of the torsion spring 130 is secured around a hub portion 124 of the rocker 120 that receives the post 118 (through bore 123). Because the spring 130 is secured proximate the axis of rotation of the rocker 120, translational movement of the torsion spring 130 is minimized during pivoting of the rocker 120 as compared to a spring attached to an outer peripheral portion of the rocker (as shown in the lock disclosed in incorporated U.S. Pat. No. 3,563,067). This reduced translational movement minimizes surface contact and dragging of the housing engaging first leg 134 of the torsion spring 130 against the inner surface of the lock body 110. As a result, wear of the spring 130 and housing 110 are minimized, providing for smoother, more consistent operation of the rocker 120.

For ease of manufacture, the torsion spring 130 may be provided with straight first and second end portions or legs 134, 133 and a single-looped center coil portion 132. As a further aspect of the present application, the rocker 120 and spring 130 may be pre-assembled together as a self-contained subassembly to facilitate simplified or automated final assembly, or to accommodate storage or shipping of these preassembled parts. While many different arrangements may be utilized to secure the torsion spring to the rocker, in one embodiment, the rocker may be provided with one or more spring fastening members that secure the torsion spring against a spring retaining surface of the rocker. In the illustrated embodiment, a spring retaining surface 121 of the exemplary rocker 120 (see FIG. 4) includes one or more tabs or projections 125, 126, 127, 128 that may be configured to secure one or more of the center coil portion 132 and first and second legs 134, 133 of the torsion spring 130 to the rocker 120. As one example, the projections 125, 126, 127, 128 may be sized or positioned to provide an interference fit with a partially preloaded or biased torsion spring 130. In another embodiment, the spring 130 may be assembled to the rocker 120 in an unloaded condition (i.e., without flexing the spring or applying a pre-load) to facilitate assembly, allowing the spring 130 to be simply dropped into place on the rocker 120. To facilitate placement and positioning of the spring 130 on the rocker 120 prior to fastening, one of the projections 128 may be positioned such that a portion of the spring 130 is received between the projection 128 and the hub 124. The second leg 133 of the torsion spring 130 may be anchored between parallel projections 125, 126, allowing for a desired orientation of the installed torsion spring 130 to be consistently maintained. Further, the first leg 134 of the torsion spring 130 may be reinforced by an adjacent projection 127. In one embodiment, the projections 125, 126, 127, 128 may be bent, coined, staked, or otherwise deformed, for example, by an automated machine staking procedure, to at least loosely retain the torsion spring 130 on the rocker 120. In other embodiments, fasteners, adhesives, or other such arrangements may be used to secure a non-preloaded torsion spring to a rocker.

In an exemplary method of manufacturing a latch subassembly for a rocker-style combination padlock, a latch member 140 and a latch member biasing spring 141 are assembled into a cavity 122 of a rocker 120 to extend from an outer periphery of the rocker, such that the latch member 140 is slideable between an extended position and a retracted position, and is biased toward the extended position by the spring 141. A pin 148 is press-fit into an aperture in the rocker in alignment with a recess 143 in the latch member to secure the latch member within the cavity 122 of the rocker 120. A torsion spring 130 is placed on a spring retaining surface 121 of the rocker 120 such that a central coil portion 132 of the torsion spring is positioned around a through bore in the rocker, a first leg 134 extending from the central coil portion extends outward of the outer periphery of the rocker, and a second leg 133 extending from the central coil portion opposite the first leg is positioned adjacent a projection 125 extending from the spring retaining surface 121 of the rocker 120. The projection 125 is deformed to secure the torsion spring 130 to the spring retaining surface 121 of the rocker. In one such exemplary method, latch installation, latch pin press-fitting, spring placement, and spring retention staking may all be performed using a single automated apparatus, thereby reducing production times, manual assembly steps, and related production costs.

Other components, arrangements, and operation of the lock 100 may, but need not, be consistent with the components, arrangements, and operations of the padlocks of incorporated U.S. Pat. Nos. 3,563,067 and 4,055,972.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A padlock comprising:

a lock body;

a shackle having a long leg and a short leg receivable in corresponding first and second shackle openings in an upper surface of the lock body and axially moveable between a retracted position and an extended position, the short leg being withdrawn from the lock body when in the extended position;

a locking mechanism disposed in the lock body, the locking mechanism comprising a plurality of tumbler discs and a user operable dial configured to selectively rotate each of the plurality of tumbler discs to an unlocking orientation; and a latch assembly disposed in the lock body, the latch assembly including a rocker pivotably mounted to a post secured to the lock body, and a latch member extending from the pivotable rocker, wherein when the plurality of tumbler discs are pivoted to the unlocking orientation, the pivotable rocker is permitted to pivot from a first position to a second position to move the latch member out of locking engagement with a recess in the short shackle leg;

wherein the latch assembly further comprises a torsion spring including first and second legs and a center coil portion between the first and second legs and assembled over the post, the first leg engaging an inner surface of the lock body, and the second leg engaging the rocker to bias the rocker toward the first position, wherein the rocker comprises at least one spring fastening member securing the torsion spring to a spring retaining surface of the rocker against movement away from the rocker along the post, wherein the torsion spring is secured to the rocker in an unloaded condition.

2. The padlock of claim 1, wherein the at least one spring fastening member engages the first leg of the torsion spring.

3. The padlock of claim 1, wherein the at least one spring fastening member engages the second leg of the torsion spring.

4. The padlock of claim 1, wherein the at least one spring fastening member engages the center coil portion of the torsion spring.

5. The padlock of claim 1, wherein the rocker comprises a hub defining a bore through which the post extends.

6. The padlock of claim 5, wherein the center coil portion of the torsion spring extends around the hub.

7. The padlock of claim 1, wherein the at least one spring fastening member comprises a projection extending from the spring retaining surface of the rocker.

8. The padlock of claim 7, wherein the projection is deformed to capture at least a portion of the torsion spring between the spring retaining surface of the rocker and a deformed portion of the projection.

9. A latch assembly for a padlock, the latch assembly comprising:

a rocker including a central through bore and a tongue extending from an outer periphery of the rocker;

a latch member slidably disposed in a cavity in the rocker; and a torsion spring assembled to a spring retaining surface of the rocker and including first and second legs extending from a center coil portion positioned around the through bore, the first leg extending beyond the outer periphery of the rocker, the second leg terminating inward of the outer periphery of the rocker and engaging a portion of the rocker to apply a biasing force against the rocker when the first leg is in a spring-loaded condition;

wherein the rocker comprises at least one spring fastening member securing the torsion spring to the spring retaining surface of the rocker; and wherein the torsion spring is assembled to the spring retaining surface in an unloaded condition.

10. The latch assembly of claim 9, wherein the at least one spring fastening member engages at least one of the first leg of the torsion spring, the second leg of the torsion spring, and the center coil portion of the torsion spring.

11. The latch assembly of claim 9, wherein the rocker comprises a hub extending from the spring retaining surface, the through bore extending through the hub.

12. The latch assembly of claim 11, wherein the center coil portion of the torsion spring extends around the hub.

13. The latch assembly of claim 9, wherein the at least one spring fastening member comprises a projection extending from the spring retaining surface of the rocker.

14. The latch assembly of claim 9, wherein the projection is deformed to capture at least a portion of the torsion spring between the spring retaining surface of the rocker and a deformed portion of the staked projection.

15. The latch assembly of claim 9, wherein the second leg is secured between first and second spring fastening members.

16. A method of manufacturing a padlock latch assembly as a self-contained subassembly, the method comprising:

assembling a latch member into a cavity of a rocker to extend from an outer periphery of the rocker, such that the latch member is slideable between an extended position and a retracted position;

placing a torsion spring on a spring retaining surface of the rocker such that a central coil portion of the torsion spring is positioned around a through bore in the rocker, a first leg extending from the central coil portion extends outward of the outer periphery of the rocker, and a second leg extending from the central coil portion opposite the first leg is positioned adjacent a projection extending from the spring retaining surface of the rocker; and after placing the torsion spring on the spring retaining surface of the rocker, deforming the projection to secure the torsion spring to the spring retaining surface of the rocker.

17. The method of claim 16, wherein placing the torsion spring on the spring retaining surface comprises placing the portion spring on the spring retaining surface in an unloaded condition.

18. The method of claim 16, wherein placing the torsion spring on the spring retaining surface comprises placing the second leg of the torsion spring between first and second projections extending from the spring retaining surface.

* * * * *